United States Patent [19]

Mashburn

[11] 4,282,736

[45] Aug. 11, 1981

[54] STOCK LIFTER

[75] Inventor: Harry G. Mashburn, Asheville, N.C.

[73] Assignee: Blue Ridge Industrial Technologies, Inc., Asheville, N.C.

[21] Appl. No.: 130,113

[22] Filed: Mar. 13, 1980

[51] Int. Cl.[3] ..... B21D 45/00

[52] U.S. Cl. ..... 72/345; 72/421; 72/427

[58] Field of Search ..... 72/344, 345, 346, 427, 72/420, 421

[56] References Cited

U.S. PATENT DOCUMENTS

| | | | |
|---|---|---|---|
| 1,285,104 | 11/1918 | Fnohm | 72/346 |
| 1,768,294 | 6/1930 | Reid | 72/345 |
| 2,326,606 | 8/1943 | Biggert | 72/346 |
| 2,979,004 | 4/1961 | Kenville et al. | 72/345 |

*Primary Examiner*—Leon Gilden

*Attorney, Agent, or Firm*—Bell, Seltzer, Park & Gibson

[57] ABSTRACT

A stock lifter for supporting and guiding strip stock materials during progressive die operations, and wherein the stock lifter has an annular groove adjacent its upper free end for supportingly receiving and guiding strip stock material. Shoulder means is provided along the body of the stock lifter for engagement of a hold-down fastener means therewith in mounting the stock lifter in a supporting die. The annular nature of the groove of the stock lifter permits the stock lifter to be installed with a hold-down fastener located at any point around the periphery of the stock lifter, thus allowing the supporting die member to be formed of reduced width and therefore a savings of material and attendant costs.

10 Claims, 8 Drawing Figures

STOCK LIFTER

FIELD OF THE INVENTION

This invention relates to stock lifters for supporting and guiding strip stock material during progressive movement of such material from one pair of opposing die members to another pair.

BACKGROUND OF THE INVENTION

Stock lifters previously have been provided arranged in pairs and spaced from one another along a row of progressive dies with lifters of each pair located at opposite side edges of a strip of sheet stock material upon which die operations were performed. There have also been provided transverse grooves near the outer or free ends and in adjacent sides of the lifters of each pair into which grooves the opposite edge portions of the strip stock material have extended for slidably supporting and guiding the strip stock material as it has progressively advanced to and from the different dies. As shown in U.S. Pat. No. 2,979,004 to Kenville, et al., these grooves have been slightly curved and extended across about the half of the periphery of the lifter that faced inwardly toward the strip stock material, and such grooves have been beveled at their edges apparently to aid in the receipt and guiding of progressive strip stock material.

These lifters have had their inner or lower end portions slidably supported in the lower die members for limited longitudinal movement in a vertical direction whereat they have been engaged by the upper die members during downward movement of the upper die members and thereby have lowered the strip stock material onto the lower supporting die members for punching, forming or other desired die operations. Springs have been located in recesses in the lower die members under the lifters which have been compressed during the lowering of the upper die members and which have then urged the lifters outward and such strip stock material upward upon the return of the upper die members to their upward inactive positions. The raising of the strip stock material has disengaged the same from the lower die members and positioned same above the parts of the lower die members so as to provide clearance for advancement of the stock material along the row of progressive dies.

In order to control the extent of upward travel of the lifters and strip stock material and to retain the lifters in the lower supporting die member, hold-down fasteners in the form of screws or bolts with circular washers have been provided outboard in the lower supporting dies located immediately adjacent to the lifters and on the side of the lifters directly opposite from the side bearing the stock supporting and guide groove. The side of the lifter so opposite such groove has heretofore been machined with a longitudinal groove, arcuate in cross-section, and extending transversely about a quarter of the way through the lifter so as to receive a corresponding portion of the hold-down fastener washer. This longitudinal groove has extended from just below the head to a medial portion of the lifter of such distance to provide for desired lifter travel. At such medial termination point there has been provided a shoulder at the bottom of such longitudinal groove to be contacted by the hold-down fastener.

This prior stock lifter arrangement has suffered from a number of shortcomings, however. Firstly, having the lifter constructed so that the hold-down fastener is oriented directly opposite from the lifter's stock material supporting and guiding groove, has meant that such hold-down fastener has had to be positioned in the lower die directly outboard the stock material receiving area, thus requiring the lower dies to be of additional sufficient width to receive such hold-down fastener, a significant economic detriment considering the substantial thickness and size of such dies. Likewise, the involved nature of the particular construction of these prior lifters has made these lifters relatively difficult to form and therefore expensive, especially considering their requirements in multiple number in typical applications. Furthermore, by being mounted so fixedly against rotation, there has been a tendency of prior stock lifters to jam and impede the progress of less than perfectly positioned strip stock material. Such fixed position against rotation has also presented single contact and bearing surfaces during use resulting in extensive localized wear.

SUMMARY OF THE INVENTION

The present invention overcomes the above disadvantages by providing an improved stock lifter of such construction that it may be installed with a hold-down fastener located at any point around the stock lifter thus allowing the supporting die members to be of reduced width and material.

Another object of the invention is to provide a stock lifter with increased stock bearing contact surface.

Another object of the invention is to provide a stock lifter which is simple in construction, economical in manufacture, and otherwise well suited for the purpose for which it is designed.

BRIEF DESCRIPTION OF THE DRAWINGS

Some of the objects and features of this invention having been stated, others will become more apparent as the description proceeds, when taken in connection with the accompanying drawings, in which.

DESCRIPTION OF THE ILLUSTRATED EMBODIMENTS

Figure 1:
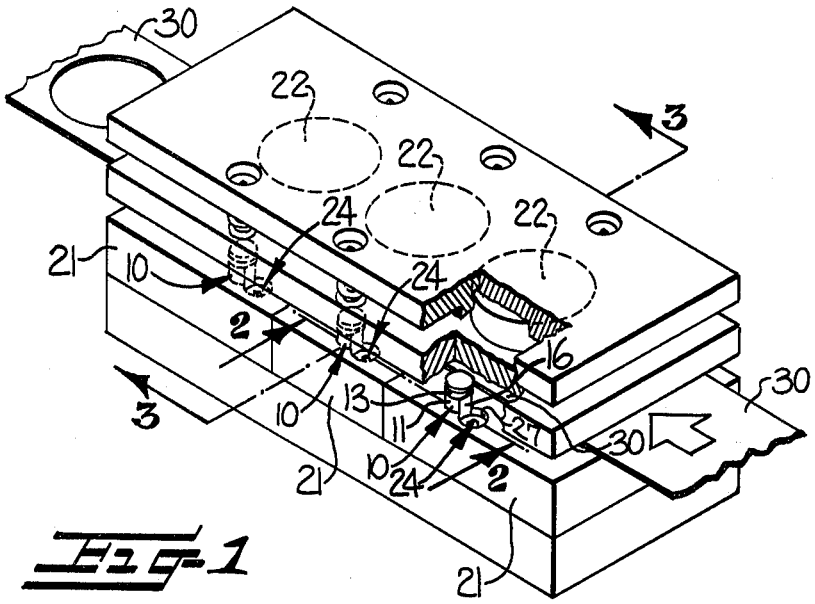
FIG. 1 is a perspective view in environmental setting illustrating a preferred embodiment of stock lifters in accordance with the invention installed in a supporting die member.

Referring now to the drawings, which illustrate particular embodiments of the invention, FIGS. 1 through 4 show a stock lifter 10 in accordance with the invention in use in a die assembly comprising spaced pairs of opposing lower and upper die members, 21 and 22 respectively, wherein a length of strip stock material 30 is being directed between said die members for die component action while being supported and guided by the stock lifters 10.

Figure 3:
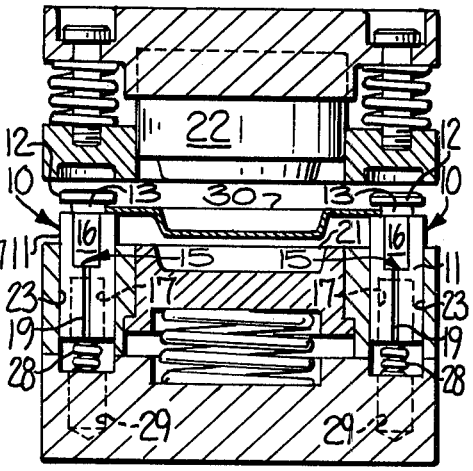
FIG. 3 is a sectional view along the line 3—3 of FIG. 1.

Although only one pair of die members is shown in FIG. 3, any number of sets may be employed and they may consist of a combination of stamping, forming, and punching dies for performing progressive operations on the stock material. Articles while being produced with an assortment of dies of this character remain a part of the strip stock material until they have arrived at the desired stage, where they are then separated from each other and the remainder or waste stock material, it being necessary to keep the partially completed articles connected together so as to control their movements and positions relative to the different sets of dies with a single feeding operation. This manner of die operation requires the raising and lowering of the strip stock material between each operation of the dies on the strip stock material because of the necessity of having all depressed portions formed on said strip stock material by said dies horizontally above all parts of the lower die members while effecting feeding operations. It is mainly for the purpose of raising and lowering and thereby supporting the strip stock material that a plurality of stock lifters positioned at opposite edges of the strip stock material are employed. Stock lifters also function as guides in slidably supporting the strip stock material against lateral movement, as well as strippers for disengaging the stock material from the dies.

Figure 4:
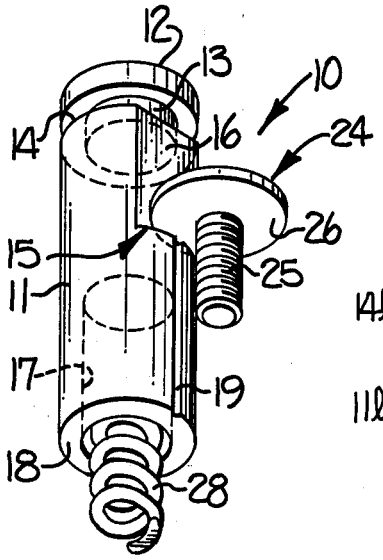
FIG. 4 is an enlarged perspective view of the preferred embodiment of the invention.

Referring now particularly to FIG. 4, the embodiment of the stock lifter 10 shown there is comprised of a basically cylindrical-like elongate body 11 which has at its upper or outer free end an annular head 12. As will be understood from viewing FIGS. 1 to 3 collectively, during die operation the annular head 12 is contacted by the upper die member 22. Adjacent to and below the head is an annular groove 13 that extends around the entire circumference of the body 11, such groove being provided to receive and thereby support and guide strip stock material 30 during the die operations. Unlike prior stock lifters which utilized a segmental groove extending across only about one-half of the periphery of the lifter and wherein stock edge contact was only intended to occur at a single predetermined point within the segmental groove, such contact may occur in this invention at any desired point around the circumference of the annular groove 13. This insures proper stock material contact with the lifter even if the stock material is not perfectly fed into the annular groove. Thereby being tolerant to feed imperfections, the circumferential annular groove 13 of the invention may be of the same width throughout as shown and have substantially square or right-angled exterior edges 14 without the necessity of rounded or beveled edge corners as appear on prior stock lifters which beveled edges were heretofore provided to allow for some tolerance for the otherwise exacting stock material contacting relationship. Aside from the advantage of not having to perform the additional machining step of beveling, right-angled edges 14 by extending essentially to the full diameters of the head 12 and body 11, provide maximum stock bearing contact surface area, while maintaining the inner diameter of the groove 13 sufficiently large enough to insure the structural integrity of the head 12 and the annular groove 13.

Below the annular groove 13 alongside the medial portion of the elongate body 11 is a shoulder means 15. As shown in FIG. 4, the shoulder means is desirably formed on and integral with the body 11 for ease of formation and maximum strength. During operation of the die members with the stock lifter in place, the body 11 of the stock lifter is slidably supported in the lower supporting die member 21 for longitudinal movement, in a recess 23 therein, parallel with the relative movement of the lower and upper die members 21 and 22. The body's inward or downward travel is limited by the lower extent of the recess 23 and the extent of its outward travel is limited by the shoulder means 15 engaging a hold-down fastener means 24.

The hold-down fastener means comprises a bolt or screw 25 which is threadably secured to the lower die member 21 and an oversize washer 26 which provides a bearing surface across its lower surface for the shoulder means 15. Along the medial portion of the body or side of the body 11 from the shoulder means 15 to the annular groove 13, the body is unobstructed for avoiding interference with the hold-down fastener means 24 during inward sliding movement of the body in the recess 23. As shown in FIG. 4, this unobstructed portion is a generally flat surface 16 for ease in fabrication and machining.

Biasing the body 11 outward from the supporting die member 21 toward the opposing, upper die member 22 is a resilient means in the form of a helical spring 28. The spring 28 is seated in the supporting die member 21 in a lower spring receiving recess 29 therein. As shown in FIG. 4, the upper portion of the spring is contained within a recess 17 within the lower portion of the body 11. There the spring contacts the interior of the body and biases it outward.

Below the shoulder means 15 alongside the medial portion of the body to the lower or supported end 18 is provided vent means 19. As shown in FIG. 4, the vent means 19 is a longitudinal groove that serves to communicate the recess areas 23 and 29 in the supporting die below the stock lifter with the atmosphere to thereby vent any air pressure build-up in the enclosed recess areas during the longitudinal movement of the stock lifter. Providing the vent means 19 externally as shown allows the air being relieved to simultaneously blow across the shoulder means 15 and keep it free of debris during die operation to forestall possible damage or premature wear of the washer 26 and shoulder bearing surfaces.

With regard to the embodiment of FIG. 4 except for shoulder means 15 and vent means 19 the elongate body 11 is generally cylindrical and of the same basic diameter throughout, that being generally the same as the head 12. Specifically, the medial portion of the body 11 above the shoulder means 15 has a somewhat smaller cross section than the head 12 or the medial portion of the body below the shoulder, due to a portion of the body being removed to form the shoulder means 15 and unobstructed flat surface 16.

With further regard to the annular groove feature of the invention, as noted above, previous stock lifters did have a stock supporting and guiding transverse opening or groove below the head of the lifter, but in those the opening or groove was of a segmental nature and extended only about one-half of the way around the circumference of the body. Also, on the opposite side of the body from such segmental groove of such previous lifters was a longitudinal concave area and shoulder for cooperating with a hold-down washer and fastener. Therefore, when previous stock lifters were installed in receiving and supporting die members, additional accommodation had to be made in the width of the supporting or lower die member for the outboard located hold-down fastener, beyond that width needed for the stock lifters and the die operations. Due to the relatively large thickness and size of typical die members, even a small amount of additional die width required a substantial amount of die material and increased costs.

Figure 2:
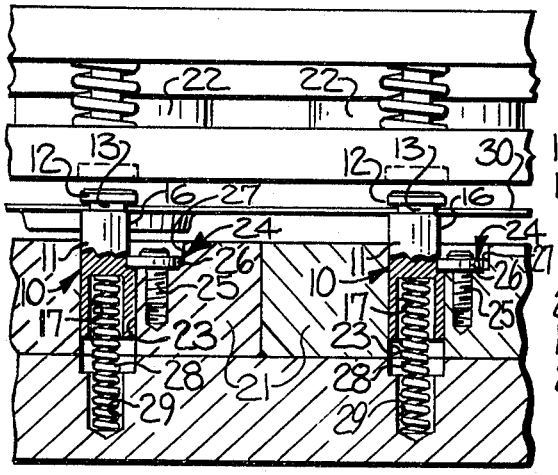
FIG. 2 is a partial sectional view along the line 2—2 of FIG. 1.

The full circumferential nature of the annular groove 13 of the invention, however, allows the stock lifter of the invention to be positioned in the supporting die member 21 in any desired orientation and then have the accompanying hold-down fastener means 24 and its accommodating recess 27 oriented at any desired location around the circumference of the lifter. As shown in FIGS. 1, 2 and 3, the stock lifter of the invention may be positioned with the hold-down fastener means 24 so located that the width and size of the die member need be no greater than the width needed to accommodate the stock lifter alone.

The lifter of the invention may be formed of any conventional durable metal material and, as shown, is desirably formed from a single, integral piece of metal for maximum strength. Standard machine shop operations can be utilized to form the various features.

In addition to the preferred embodiment of the invention shown in FIG. 4, other variations and embodiments are shown in FIGS. 5 through 8. These additional embodiments will bear the same reference numerals as heretofore used for similar components or features but with respective suffixes a, b or c added thereto.

Figure 5:
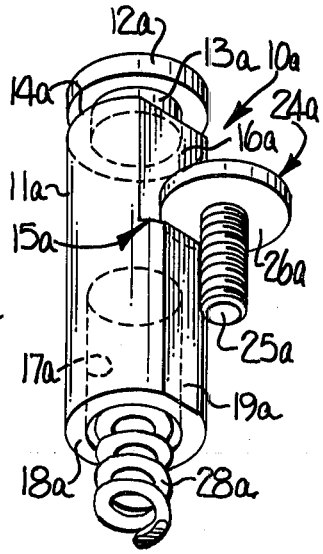
FIG. 5 is a view similar to FIG. 4 illustrating another embodiment of the invention.

First of all, shown in FIG. 5 is an embodiment of the invention identical to the embodiment of FIG. 4 with the exception of vent means 19*a* thereon being in the form of a longitudinal flat area instead of a groove. In certain instances the longitudinal flat area may be desired as easier to form than the groove.

Figure 6:
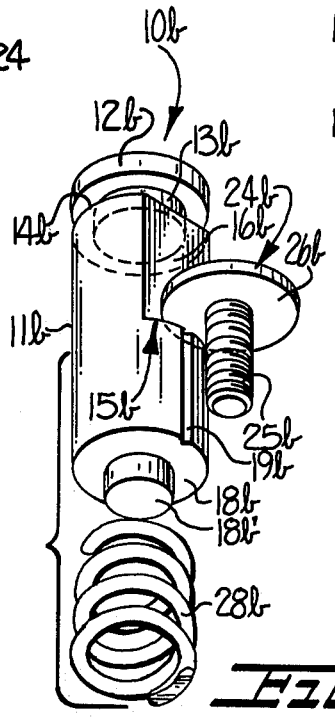
FIG. 6 is a view similar to FIG. 4 illustrating another embodiment of the invention as applied to smaller size stock lifters.

Next, shown in FIG. 6 is an embodiment of the invention also essentially identical to the embodiment of FIG. 4 illustrating a variation preferred for smaller stock lifters. Particularly, as the stock lifter size decreases, it becomes more difficult to form a recess within the lower portion of the body 11*b* and also to provide a spring sufficiently large to be satisfactorily operable. Therefore, the end-most portion of the lower or inner end 18*b* of the body 11*b* is of a reduced diameter to define a short stud 18*b*′ for receiving thereon the upper end of helical spring 28*b*.

Figure 7:
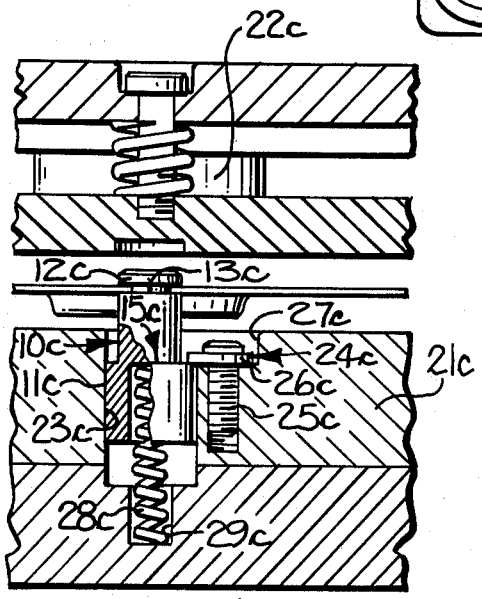
FIG. 7 is a partial sectional view similar to FIG. 2 only showing yet another embodiment of the invention.
Figure 8:
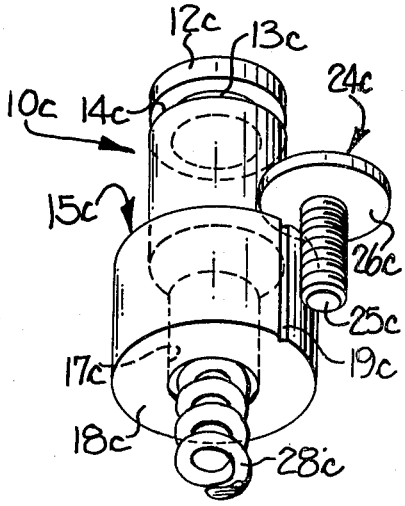
FIG. 8 is an enlarged perspective view similar to FIG. 4 but showing the embodiment illustrated in FIG. 7.

Shown in FIGS. 7 and 8 is still another embodiment of the invention which basically differs over all of the other embodiments in that the stock lifter is constructed with an annular shoulder means 15*c* for cooperating with a hold-down fastener means 24*c* so as to permit the stock lifter to rotate during use. It will be appreciated that the annular shoulder means 15*c* readily permits the hold-down fastener means 24*c* to be oriented at any location around the annular shoulder. Also, the annular nature of the shoulder means 15*c* and the manner in which the hold-down fastener means 24*c* cooperates therewith, together with the absence of any flat surface 16, 16*a* or 16*b*, as in the respective earlier embodiments readily permits the stock lifter to be rotated during use by engagement of the strip stock material being guidingly received in the annular groove 13*c* thereof.

It is to be understood that the forms of the invention herein shown and described are to be taken as particular embodiments of the invention and that various changes in the shape, size and arrangement of parts thereof may be resorted to without departing from the spirit of the invention, or the scope of the authorized claims.

What is claimed is:

1. A stock lifter for use in pairs and at opposite edge portions of strip stock material for supporting and guiding such stock material from one pair of relatively movable opposing die members to another pair and for moving such stock material out of engagement with die members during separation of the die members following successive die operations on such stock material, said stock lifter being characterized as being capable of being positioned in any desired orientation in a supporting die member thereby effectively serving to reduce the amount of material required for the formation of such supporting die member, said stock lifter comprising an elongate body adapted to be slidably supported in one of the die members for longitudinal movement parallel with the relative movement of the die members, resilient means cooperating with and acting upon said elongate body for biasing said body outwardly from the supporting die member in a direction towards an opposing die member, said elongate body having a head defining an outer free end thereof with an annular groove extending around the entire circumference of said body adjacent to and below said head, and adapted for supporting and guiding the strip stock material during die operation, shoulder means located on and alongside the medial portion of said elongate body and adapted for being engaged by a hold-down fastener located in the supporting die member to retain said stock lifter and limit its extent of outward travel from the supporting die member, the medial portion of said elongate body being unobstructed from said shoulder means to adjacent said annular groove for avoiding interference with the inward sliding movement of the elongate body as when the die members are moved to closed position, and the annular nature of the stock supporting and guiding groove allowing said shoulder means and said unobstructed medial portion of said elongate body along with a hold-down fastener in the supporting die member to be oriented at any desired location around the circumference of the stock lifter instead of otherwise being positioned opposite that portion of the stock lifter supporting and guiding the strip stock material as heretofore, thereby allowing the supporting die member to be formed of a reduced width of material.

2. The stock lifter of claim 1 wherein the width of the stock supporting and guiding groove is generally the same throughout such groove and wherein the exterior edges of such groove are substantially right-angled and adapted to provide maximum bearing contact area for the stock material supported and guided therethrough.

3. A stock lifter for use in pairs and at opposite edge portions of strip stock material for supporting and guiding such stock material from one pair of relatively movable opposing die members to another pair and for moving such stock material out of engagement with die members during separation of the die members following successive die operations on such stock material, said stock lifter being characterized as being capable of being positioned in any desired orientation in a supporting die member thereby effectively serving to reduce the amount of material required for the formation of such supporting die member, said stock lifter comprising an elongate body adapted to be slidably supported in one of the die members for longitudinal movement parallel with the relative movement of the die members, resilient means cooperating with and acting upon said elongate body for biasing said body outwardly from the supporting die member in a direction towards an opposing die member, said elongate body having a head defining an outer free end thereof and integral therewith with an annular groove extending around the entire circumference of said body adjacent to and below said head, and adapted for supporting and guiding the strip stock material during die operation, shoulder means located on the medial portion of said elongate body and integral therewith and adapted for being engaged by a hold-down fastener located in the supporting die member to retain the stock lifter and limit its extent of outward travel from the supporting die member, the end portion of said elongate body extending from said shoulder means to an inner end being generally cylindrical in shape and of generally the same diameter as said head, the medial portion of said elongate body from said shoulder means to adjacent said annular groove being of a reduced cross-sectional area from that of the remaining portion of said elongate body and being unobstructed for avoiding interference with the inward sliding movement of the elongate body as when the die members are moved to closed position, and the annular nature of the stock supporting and guiding groove allowing said shoulder means and said unobstructed medial portion of said elongate body along with a hold-down fastener in the supporting die member to be oriented at any desired location around the circumference of the stock lifter instead of otherwise being positioned opposite that portion of the stock lifter supporting and guiding the strip stock material as heretofore, thereby allowing the supporting die member to be formed of a reduced width of material.

4. The stock lifter of claim 3 wherein the width of the stock supporting and guiding groove is generally the same throughout such groove and wherein the exterior edges of such groove are substantially right-angled and adapted to provide maximum bearing contact area for the supporting and guiding of stock material therethrough.

5. The stock lifter of claim 3 or 4 wherein said unobstructed medial portion of said elongate body comprises a relatively flat surface.

6. The stock lifter of claim 3 or 4 wherein said elongate body has vent means operably associated therewith for providing for the venting of air pressure build-up below the stock lifter in the supporting die member during longitudinal movement of the stock lifter.

7. The stock lifter of claim 3 or 4 wherein said elongate body further comprises a recess at its inner end for receiving therein at least a portion of said resilient means.

8. A stock lifter for use in pairs and at opposite edge portions of strip stock material for supporting and guiding such stock material from one pair of relatively movable opposing die members to another pair and for moving such stock material out of engagement with die members during separation of the die members following successive die operations on such stock material, said stock lifter being characterized as being capable of being positioned in any desired orientation in a supporting die member thereby effectively serving to reduce the amount of material required for the formation of such supporting die member, said stock lifter comprising an elongate body adapted to be slidably supported in one of the die members for longitudinal movement parallel with the relative movement of the die members, resilient means cooperating with and acting upon said elongate body and adapted for biasing said body outwardly from the supporting die member in a direction towards an opposing die member, said elongate body having a head defining an outer free end thereof and integral therewith with an annular groove extending around the entire circumference of said body adjacent to and below said head, and adapted for supporting and guiding the strip stock material during die operation, shoulder means located on the medial portion of said elongate body and adapted for being engaged by a hold-down fastener located in the supporting die member to retain the stock lifter and limit its extent of outward travel from the supporting die member, the end portion of said elongate body extending from said shoulder means to an inner end being cylindrical with the end-most portion thereof being of a reduced diameter compared to the remainder thereof, said reduced diameter end-most portion being received within said resilient means, the medial portion of said elongate body from said shoulder means to adjacent said annular groove being of a reduced cross-sectional area than that of the remaining portion of said elongate body and being unobstructed for avoiding interference with the inward sliding movement of the elongate body as when the die members are moved to closed position, and the annular nature of the stock supporting and guiding groove allowing said shoulder means and said unobstructed medial portion of said elongate body along with a hold-down fastener in the supporting die member to be oriented at any desired location around the circumference of the stock lifter instead of otherwise being positioned opposite that portion of the stock lifter supporting and guiding the strip stock material as heretofore, thereby allowing the supporting die member to be formed of a reduced width of material.

9. A stock lifter for use in pairs and at opposite edge portions of strip stock material for supporting and guiding such stock material from one pair of relatively movable opposing die members to another pair and for moving such stock material out of engagement with die members during separation of the die members following successive die operations on such stock material, said stock lifter being characterized as being capable of being positioned in any desired orientation in a supporting die member thereby effectively serving to reduce the amount of material required for the formation of such supporting die member, said stock lifter comprising an elongate body adapted to be slidably supported in one of the die members for longitudinal movement parallel with the relative movement of the die members, resilient means cooperating with and acting upon said elongate body for biasing said body outwardly from the supporting die member in a direction toward an opposing die member, said elongate body having a head defining an outer free end thereof with an annular groove extending around the entire circumference of said body adjacent to and below said head, and adapted for supporting and guiding the strip stock material during die operation, annular shoulder means located on the medial portion of said elongate body and adapted for being engaged at any point thereon by a hold-down fastener located in the supporting die member to retain said stock lifter and limit its extent of outward travel from the supporting die member, the medial portion of said elongate body being unobstructed from said shoulder means to adjacent said annular groove for avoiding interference with the inward sliding movement of the elongate body as when the die members are moved to closed position, and the annular nature of both the shoulder means and the stock supporting and guiding groove allowing, the stock lifter to be rotated within the supporting die member to evenly distribute any wear of the shoulder and groove during extended operation of the stock lifter, and allowing a hold-down fastener in the surrounding die member to be oriented at any desired location around the circumference of the stock lifter instead of otherwise being positioned opposite that portion of the stock lifter supporting and guiding the strip stock material as heretofore, thereby allowing the supporting die member to be formed of a reduced width of material.

10. The stock lifter of claim 9 wherein vent means is operably associated with said elongate body for providing for the venting of air pressure build-up below the stock lifter in the supporting die member during movement of the stock lifter.

* * * * *